US005135043A

United States Patent [19]

Drake

[11] Patent Number: 5,135,043

[45] Date of Patent: Aug. 4, 1992

[54] APPARATUS AND METHOD FOR GAS CURING FOUNDRY CORES AND MOLDS

[75] Inventor: Daniel A. Drake, Wauwatosa, Wis.

[73] Assignee: Omco USA, Inc., Milwaukee, Wis.

[21] Appl. No.: 543,022

[22] Filed: Jun. 25, 1990

[51] Int. Cl.[5] ..... B22C 9/12

[52] U.S. Cl. ..... 164/456; 164/16; 164/154; 164/159

[58] Field of Search ..... 164/456, 16, 12, 154, 164/159

[56] References Cited

U.S. PATENT DOCUMENTS

| | | | |
|---|---|---|---|
| 3,008,205 | 11/1961 | Blaies, Jr. | 164/16 |
| 3,590,902 | 7/1971 | Walker et al. | 164/16 X |
| 3,937,272 | 2/1976 | Flora et al. | 164/16 X |
| 4,051,886 | 10/1977 | Ross | 164/16 |
| 4,079,773 | 3/1978 | Dunlop | 164/16 |
| 4,089,363 | 5/1978 | Dunlop | 164/16 |
| 4,112,515 | 9/1978 | Sandow | 366/17 |
| 4,132,260 | 1/1979 | Lüber | 164/16 |
| 4,232,726 | 11/1980 | Michelson | 164/12 |
| 4,359,082 | 11/1982 | Michel | 164/16 |
| 4,362,204 | 12/1982 | Moore et al. | 164/16 |
| 4,483,384 | 11/1984 | Michel | 164/154 |
| 4,540,531 | 9/1985 | Moy | 261/141 |
| 4,605,052 | 8/1986 | Morley | 164/16 |
| 4,644,994 | 2/1987 | Michel | 164/154 X |
| 4,878,533 | 11/1989 | Wear et al. | 164/16 |
| 4,886,105 | 12/1989 | Nisi et al. | 164/16 |
| 5,005,630 | 4/1991 | Gähler | 164/159 X |

FOREIGN PATENT DOCUMENTS

| | | |
|---|---|---|
| 962431 | 2/1975 | Canada . |
| 3546000 | 6/1987 | Fed. Rep. of Germany . |
| 2159163A | 11/1985 | United Kingdom . |

*Primary Examiner*—J. Reed Batten, Jr.
*Attorney, Agent, or Firm*—Jansson & Shupe, Ltd.

[57] ABSTRACT

An improved apparatus for gas curing foundry cores includes an instrument system for attachment to a source of curing gas such as a gas generator. The system includes a signal generating section for providing a plurality of first signals. These signals represent the instantaneous mass flow rate of gas flowing to the core box. A counter/controller section is coupled to the signal generating section and totalizes the first signals. A valve device is coupled to the counter/controller section, opened to initiate the flow of gas to the core box and closed to terminate the flow of gas. The valve is opened upon receipt of a signal initiating the curing process and closed when the total of the first signals reaches a value representing a predetermined total mass of gas which has flowed to the core box. The improved method includes initiating flow of a gas to a core box containing raw cores to be cured. The gas includes a curing constituent, either in substantially pure form or mixed with a carrier gas. Upon commencement of gas flow, the mass of the gas is repetitively determined as a "running total". When the total mass of curing constituent into the core box has reached a predetermined value, flow is terminated.

13 Claims, 1 Drawing Sheet

APPARATUS AND METHOD FOR GAS CURING FOUNDRY CORES AND MOLDS

FIELD OF THE INVENTION

This invention is related generally to curing of foundry cores and molds prior to their use in the manufacture of castings and, more particularly, to an improved apparatus and method for gas curing foundry cores and molds wherein the actual total mass of curing gas permitted to flow to the core box is measured and the curing process terminated when such mass reaches a predetermined value.

BACKGROUND OF THE INVENTION

Forming metals into useful products by casting is an old art, perhaps among the oldest. One type of casting technique involves the creation of a core, the size and shape of which determines the configuration of that part of the product which is devoid of metal. Stated another way, the core represents the shape of the "space" within the finished article.

One type of core is made of finely divided silica sand which is thoroughly mixed with a binder. This sand-binder mixture is formed to the proper shape and hardened. A relatively hard, robust core is a necessity since prior to actual pouring of the molten metal, the core may be subjected to a degree of physical abuse as it is handled in the foundry. The core is also subjected to thermal shock as it comes in contact with the molten metal from which the final product is made. Examples of products which are cast using cores of the type described above are cast iron automobile engine blocks, pump housings and impeller blades to name but a few.

After the sand and binder are mixed and the core formed, it must then be cured to impart those physical properties to the core which are necessary for high quality cast products. These physical qualities include core hardness, shelf life, dimensional accuracy and shakeout characteristics, among others. Such qualities can be dramatically affected by the curing process. Clearly, the process used to make cores must be closely controlled both at the core making step and in the casting step to result in cores of high quality.

Two of several curing processes are called "hot box" and "cold box" processes. In the former, an uncured core is subjected to an elevated temperature at a controlled level and for a controlled length of time. While this method of curing cores is widely and successfully used, it is extremely energy intensive. The cost of hot box curing by the use of oil or gas can be dramatically affected by the price of those fuels.

Cold box curing is also widely used to manufacturer foundry cores. With this approach, the sand and binder are combined to form a homogeneous mixture which is then shaped into a raw core. Following such shaping, the cores are confined within a closed space (called a core box) into which a gaseous curing agent is introduced. Since raw cores made of sand and binder have a degree of porosity, this curing gas penetrates through the entirety of the core to harden the binder, thereby preparing the core for the casting process. There are several binders which are suitable for gas curing processes and among them are phenolic urethane epoxy resins, furan resins, phenolic resole resins and sodium silicate. Similarly, there are a number of curing gases suitable for such processes, carbon dioxide, sulfur dioxide, methyl formate, dimethylamine (DMEA) and triethylamine (TEA) being among them. Neither the binders nor the curing gases are listed in any particular order. Further, the listed binders and curing gases are not necessarily compatible with one another. However, compatible combinations of binders and gases are well known.

For a given core, the amount of sand required and the amount of binder needed to form that sand into a usable core may be rather precisely determined. For example, in a cold box process which uses an epoxy resin cured by sulfur dioxide (known as the epoxy gas hardening or EGH process), the weight or mass of the epoxy resin binder as a percent of sand weight will be in the range of 0.6% to 1.2%, depending upon the type of sand used and the strength requirements of the core. Similarly, the weight of binder used in the TEA process is about 1.2% of the weight of the sand to be bound. Since the mass of the binder can be readily determined for a particular core, the mass of gas needed to cure the binder in that particular core can also be rather readily determined using stoichiometric data.

The stoichiometric value is the precise amount of gas needed to cure a particular quantity of binder and excludes losses. However, it is difficult if not impossible to reliably and properly cure a core using only the stoichiometric quantity of curing gas. This is so since in common core manufacturing methods, sand and binder are blown into the core box cavity using forced air and this cavity is vented to permit the air to escape. Since these vents are not closed during the gassing or curing process, some of the curing gas also escapes through them and is ineffective to cure the binder. The amount of curing gas lost is also dependent upon the pressure at which the sections of the core box are clamped together and the integrity of the edge sealing gaskets.

Notwithstanding the foregoing and even considering gas loss through the vents, across the seals and the like, foundrymen can and do very quickly learn how to achieve proper curing.

Frequently, this is done on a judgmental or experimental basis. That is, curing gas is permitted to flow to raw cores for progressively increasing times until proper curing occurs. The time required to effect such proper curing is then noted and used as the standard. For example, U.S. Pat. No. 4,540,531 (Moy) discusses a vapor generating system which effects core curing on a time basis. The pressure and temperature of the gas vapor generating vessel are controlled and a resulting density of the curing gas is assumed rather than being actually measured. If the pressure and/or temperature of the gas generating vessel stray from the desired values, undercuring or overcuring can result.

Some cold box processes use a substantially pure curing gas, the EGH process being an example. It uses sulphur dioxide in full concentration. However, it is often desirable to cure cores by using a smaller amount of curing gas blended with carrier gas to reduce the concentration of curing gas. The free radical curing (FRC) process is an example. Such processes may use a mixture of an inert carrier gas, nitrogen for example, and a curing constituent, sulphur dioxide. A concentration of sulphur dioxide of 1%–10% is normal. U.S. Pat. No. 4,112,515 (Sandow) describes how to mix the carrier gas and the curing gas or catalyst so that the ratio of the mass of the catalyst to that of the carrier gas is carefully maintained.

With many binder and curing gas combinations, "under gassing" the binder results in an undercured, unusable core which must be scrapped. On the other hand, "over-gassing" is usually not injurious to the physical properties of the core. Therefore, it is a common practice to overgas cores although the quality of cores made with some types binders can be impaired by overgassing.

Overgassing has a number of adverse effects. Perhaps the most serious of these is that even though the gas stream from the core box vent is "scrubbed" to remove possibly-harmful constituents, some of these constituents inevitably enter the environment. Yet another disadvantage of overgassing is that the cost of curing foundry cores is unnecessarily increased.

A third disadvantage of over-gassing is that when the cores are removed from the core they are often excessively permeated with the curing gas. At the least, the odor of some curing gases is unpleasant to the foundry men called upon to handle the cured cores. In an extreme case, the quantity and toxicity of the curing gas escaping from the highly permeated core may require that the foundry men wear protective clothing and breathing apparatus.

Yet another disadvantage of known systems is that the rate at which curing gas is being consumed from a storage tank may be only roughly approximated. The result is that cylinders from which curing gas is generated are either changed too frequently (thus wasting the residual liquid) or the operator is forced to replace cylinders at an undesirable point in the core manufacturing process. Control of curing gas inventory and process continuity are unnecessarily difficult to manage using conventional gas curing methods and such methods do not lend themselves well to the creation of batch processing or inventory control records.

An improved apparatus and method for gas curing foundry cores which can dramatically reduce curing gas waste, which provides precisely the proper amount of curing gas notwithstanding variations in the performance of the gas generator, which simplifies inventory and process control and which permits the creation of a written record of the way in which a particular batch of cores was cured would be an important advance in the art.

OBJECTS OF THE INVENTION

It is an object of this invention to overcome some of the problems and shortcomings of the prior art.

Another object of this invention is to provide an improved apparatus for gas curing foundry cores which permits a predetermined mass of gas to flow to the core box.

Another object of this invention is to provide an improved apparatus for gas curing foundry cores which includes an instrument system for determining the mass of curing constituent flowing to the core box.

Another object of this invention is to provide an improved apparatus for gas curing foundry cores which is useful with pure curing gases and with gases which are a mixture of a carrier gas and a curing constituent.

Another object of this invention is to provide an improved method for gas curing foundry cores wherein a determination is made of the mass flow rate of the gas flowing to the core box.

Another object of this invention is to provide an improved method for gas curing foundry cores wherein the flow of gas to the core box is terminated when the total mass of gas which has flowed to the core box reaches a predetermined value.

These and other important objects will be apparent from the descriptions of this invention which follow.

SUMMARY OF THE INVENTION

The apparatus and method disclosed herein is equally applicable to the manufacture of cores and/or molds and is to be so interpreted. That is, the use of the term "core" or "cores" herein is assumed to also mean "mold" or "molds", either additionally or in the alternative.

An improved apparatus for gas curing foundry cores includes an instrument system for attachment to a source of curing gas such as a gas generator. The instrument system includes a signal generating section for providing a plurality of first signals. These signals represent the instantaneous mass flow rate of gas flowing to the core box. The instrument system also includes a counter/controller section which is coupled to the signal generating section and totalizes the first signals. A valving device is coupled to the counter/controller section and is positionable to an open state which initiates the flow of gas to the core box. The valving device can also be positioned to a closed state which terminates the flow of gas to the core box. The device is opened upon receipt of a signal which initiates the curing process and is closed when the total of the first signals reaches a value representing a predetermined total mass of gas which has flowed to the core box.

In a highly preferred embodiment, the signal generating section includes a sensing section for providing signals which repetitively define a parameter. The defined parameter has a value which varies as a function of the mass flow rate of the gas flowing through the sensing section.

An electronic section is coupled to the sensing section for receiving the sensed signals. It processes these signals and responsively provides a plurality of first signals, each of which represents a mass flow rate. These first signals are totalized by a counter/controller section which is coupled to the electronic section and also to a valving device . When the totalized first signals reach a predetermined value, the valving device is shut off.

The inventive apparatus is unique in that it accomplishes the core curing process by directly determining the mass or weight of curing gas which has flowed to the core box subsequent to the initiation of a particular curing cycle. When the actual mass of gas which has flowed to the core box becomes equal to a predetermined mass of gas, the process is terminated. Therefore, the improved apparatus (and the method described below) effect precisely controlled gas curing independent of variations in gas generator pressure or other variables which could affect the quality of the finished core.

An improved method for gas curing foundry cores includes initiating flow of a gas to a core box, such gas including a curing constituent. Then the mass flow rate of the gas flowing to the core box is determined and the flow of gas is terminated when the total mass of gas which has flowed to the core box reaches a predetermined value. The gas may be a substantially pure curing constituent or may be a mixture of a carrier gas and a curing constituent.

Both the inventive apparatus and method lend themselves to a variety of gas curing situations. One such situation involves the use of a substantially pure curing constituent, sulfur dioxide for example. Since sulfur dioxide has a known mass and since the mass flow rate of such gas flowing through the sensing section may be determined, the total mass of gas which has been permitted to flow to the core box may be determined at any instant following the initiation of the curing cycle. Gas flow is then terminated when the total mass of gas reaches a predetermined value.

The apparatus and method may also be used in another situation where a mixture of a carrier gas and a curing constituent is used in lieu of a substantially pure curing gas. An example of such a mixture include 95% nitrogen (an inert carrier gas) and 5% sulphur dioxide, the curing catalyst. Since the mass of each gas is known, the mass of an 95%-5% mixture can be determined. Since the instrument system will normally be arranged to determine the mass flow rate of the mixture, the mass of the sulphur dioxide curing gas which flows to the core may be computed. As prior described, the flow of the gas mixture is then terminated when the mass of either the gas mixture or the curing constituent which has flowed to the core reaches a predetermined value.

Yet another situation in which the improved apparatus and method may advantageously be used is in a process similar to that described above but wherein the ratio of the two gases in the mixture is not carefully controlled. In such a situation, the mass of the mixture may change slightly during the curing cycle. Such changes in mass are detected by the instrument system and can be used in either or both of two ways. The process can be terminated when density strays outside a set of boundary values or the system can be arranged to give on-line indications of changes in density.

DETAILED DESCRIPTIONS OF PREFERRED EMBODIMENTS

Figure 1:
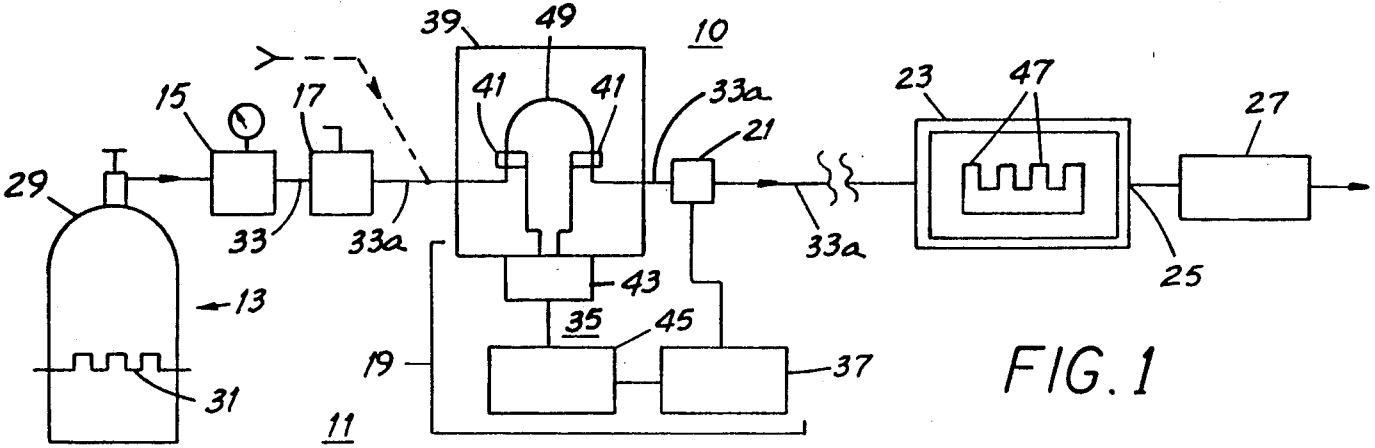
FIG. 1 is a simplified diagram of an arrangement for gas curing foundry cores which includes the inventive apparatus and which may be used to carry out the method of the invention.
Figure 3:
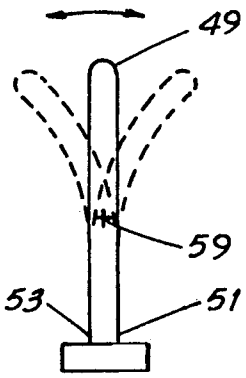
FIG. 3 is a side elevation view of a portion of the meter shown in FIG. 2, taken along the viewing plane 3—3 thereof, with parts omitted and other parts shown in phantom view and in exaggerated extremes of position.

Referring to FIG. 1, the improved apparatus 10 for gas curing foundry cores is shown in connection with a core gassing or curing arrangement 11. The primary components of the arrangement 11 include a source 13 of pressurized gas, a pressure regulator 15, a shut off valve 17, an instrument system 19, a valving device 21 and a core box 23. The downstream vent 25 of the core box 23 is preferably connected to a scrubber 27 for removing or neutralizing certain by-products resulting from the curing process. The source 13 may be embodied as any of several types of common gas generators. Specific types of gas generators include injector types, bubbler types and boiler types. Merely as an example, the source 13 shown in FIG. 1 is embodied as a boiler type and includes a cylinder 29 for confining the liquid catalyst and heater 31 to heat such catalyst above its boiling point to form a pressurized vapor. Irrespective of the specific type, such generators convert the liquid catalyst to a vapor and thereby make the resulting gaseous curing constituent available for core curing. The curing constituent may be used in substantially pure form or, just as commonly, it may be mixed with an inert carrier gas.

The pressure regulator 15 helps provide a stream of gas as a substantially constant pressure to the instrument system 19 and the core box 23. While the invention avoids the necessity of such a regulator 15, such use is common practice. The shut off valve 17 permits closure of the generator feed conductor 33 to permit servicing or replacement of the instrument system 19, the valving device 21 or any other component 11 of the arrangement which is downstream of the valve 17.

The inventive apparatus 10 includes the instrument system 19 and the valving device 21. The instrument system 19 includes a signal generating section 35 for providing a plurality of first signals representing the mass flow rate of gas flowing to the core box 23. This system 19 further includes a counter/controller section 37 which is coupled to the signal generating section 35 for totalizing the first signals.

The valving device 21 is coupled to the counter/controller section 37 and is positionable between an open state and a closed state. Opening of the valving device 21 occurs upon receipt of a signal initiating the curing process. The device 21 is opened to initiate the flow of gas to the core box 23 and is closed for terminating such flow of gas. Such closure occurs when the total of the first signals reaches a value representing a predetermined mass of gas which has flowed to the core box 23.

In a highly preferred embodiment, the signal generating section 35 includes a flow meter 39 having sensors 41 and a sensing section 43 coupled to the sensors for providing sensed signals which repetitively define a parameter. The value of this parameter varies as a function of the mass flow rate of the gas flowing through the meter 39.

An electronic section 45 is coupled to the sensing section 43 and receives the sensed signals, processes such signals and responsively provides a plurality of first signals. These first signals are directed to the counter/controller section 37 which totalizes them. Prior to initiation of the process, the section 37 has programmed within it a value which represents a predetermined mass of gas to be introduced into the core box 23. This predetermined value includes two components. One component is the stoichiometric mass or weight of curing constituent which is required for the particular quantity and type of binder used to make the cores 47. Another component of the predetermined value is that mass of curing constituent which will need to be introduced into the core box 23 but which will nevertheless not be available to cure the binder. This excess mass may be lost through the core box vent 25, across box seals or may be ineffectively circulated in the box 23 and will not contact the cores 47. The amount of such excess mass may be determined experimentally or judgmentally and once determined for a particular set of cores 47, curing equipment and conditions, tends to consistently repeat and therefore be highly predictable.

Once the components of stoichiometric mass and excess mass are determined, they are totalled to establish the predetermined mass of curing constituent which is to be permitted to flow to the core box 23. It is this value which is programmed or entered into the counter/controller section 37.

Upon initiation of the process, the instrument system 19 makes repetitive samplings of the instantaneous mass flow rate of gas flowing to the core box 23. These samplings will be closely spaced in time, being separated by perhaps only a few milliseconds. The instrument system 19 continuously processes these samplings and provides the first signals which are totalized by the counter/controller section 37. When the total mass represented thereby becomes equal to the value of the predetermined mass of gas entered into the section 37, the curing process is terminated by closing the valving device 21.

Several types of known instrument systems 19 may be used to construct the inventive apparatus and to carry out the inventive method. One preferred instrument system 19 includes a mass flow meter made by Micro Motion, Inc., of Boulder, Colo. While such instrument system 19 per se is known, a basic understanding of its operation will be helpful in appreciating the invention.

Figure 2:
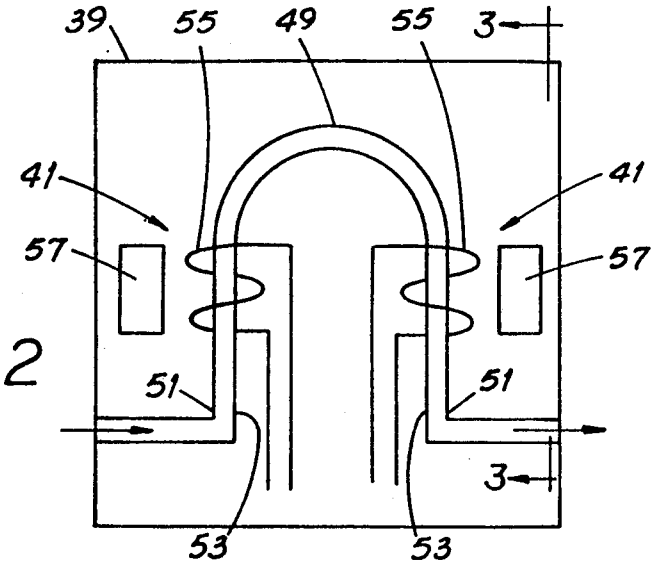
FIG. 2 is an enlarged front elevation view of a portion of the exemplary flow meter shown in FIG. 1.

As shown in the FIGURES, such flow meter 39 uses an inverted, generally U-shaped flow tube 49 which is supported at the end of each leg 51. This permits the curved position of the tube 49 to be vibrated at the natural frequency of the tube 49 by an electromagnetic drive system (not shown). Vibration is similar to that of a tuning fork and typically has a maximum amplitude of less than one millimeter and a frequency of about 80 Hz. To a viewer of FIG. 1, the tube moves in an out of the paper with the top of the tube 49 experiencing the greatest excursion. As shown in FIGS. 1 and 2, the points 53 at which the legs 51 are connected experience no excursion and the magnitude of vibratory excursion gradually increases as the tube 49 is viewed from bottom to top in FIG. 2.

A pickup coil 55 is wound about each leg 51 and a permanent magnet 57 is placed in close proximity to each coil 55. As each coil 55 vibrates, it cuts electromagnetic lines of flux and a current is produced. In a known manner, the magnitude of this current will be proportional to the rate at which such lines of force are cut. Since the velocity of each coil 55 (like that of a freely swinging pendulum) is maximum at the centerpoint of its excursion (and zero at the excursion boundaries), the current in each coil 55 will be maximum when the coil 55 and its associated leg 51 are coincident with the reference axis 59.

If no fluid is flowing through the tube 49, both legs 51 of the tube 49 are simultaneously and repetitively coincident with the reference axis 59. Stating it another way, the legs 51 will be in phase. If a mass of gas is flowing through the tube 49, the tube 49 will "twist" and its legs 51 will become "out of phase" with one another. Further, the degree to which they are out of phase varies with mass flow rate. When instantaneous tube leg position is described with respect to the reference axis 59 (while fluid is flowing) it may be said that one leg 51 will be coincident with the reference axis 59 prior to the time that the other leg 51 is coincident with the same axis 59. The difference between these two times constitutes a defined parameter, time difference in this case, the value of which varies as a function of the mass flow rate of the gas flowing through the meter 39.

The foregoing equipment of Micro Motion, Inc., is described merely by way of example and comparable instrument systems 19 are available from other manufacturers such as Fluid Components, Inc., of San Marcos, Calif., Kurz Instruments, Inc., of Monterey, Calif.; and Omega Engineering, Inc., of Stamford, Conn.

When constructing the arrangement of FIG. 1, certain practices should be observed. One is that the conductor 33 and other conductors **33*a* are preferably of a type having rigid walls. That is, the conductors 33, 33*a* are preferably selected so that their cross sectional area does not change or changes only very little with changes in pressure in the conductors 33, 33*a*. To state it another way, a flexible conductor which expands appreciably at the pressures encountered in the arrangement 11 will tend to impair the accuracy of the flow meter 39 and of the apparatus 10 and process. Further, the flow meter 39 and source 13 are preferably selected so that the pressure drop across the flow meter 39** is less than about 40% of source pressure.

In addition, the valving device 21 is preferably coupled as closely as possible to the flow meter 39 so that the length of conductor **33*a* between the valving device 21 and the flow meter 39 is minimized. The valving device 21** should be selected to provide dead tight shut off (or nearly so) and should be fast acting.

When using the improved apparatus 10, the operator first computes the value which represents the predetermined mass of gas which is required to flow to the core box 23. This gas may be a substantially pure curing constituent or it may be a mixture of a carrier gas and a curing constituent. The mass may be determined as described above and that value is then entered in the counter/controller section 37 and becomes the reference value. The flow of gas to the core box 23 is then initiated.

The mass of the gas which has flowed to the core box 23 from the time of such initiation is repetitively determined by the instrument system 19. The flow of gas is terminated when the total mass of gas which has flowed to the core box 23 from the time of such initiation reaches a predetermined value. Some examples are set forth to illustrate the inventive apparatus and method.

It is assumed that the core box 23 contains forty 5 lb. raw cores 47 to be cured and thereby hardened. If an epoxy gas hardening (EGH) process is used, the sand which makes up the cores 47 is mixed with about 1% by weight of the epoxy binder—about 0.05 lb. per core 47 or 2.0 lbs. total. Substantially pure sulphur dioxide is used as the curing gas and the stoichiometric consumption of curing gas for such conditions is about 0.025 lb. per core 47 or about 1.0 lb. total. However, the excess mass (as described above) may be about 0.0375 lb. per core 47 (1.5 lbs. total), making a total predetermined value of 2.5 lbs. of sulphur dioxide which is required to be flowed to the core box 23 as the curing constituent.

A value which represents 2.5 lbs. is then programmed into the counter/controller section 37 and the curing cycle is initiated. In commonly available instrument systems 19, initiation is by depressing a "start" button. This causes the valving device 21 to be opened and permits gas to flow from the source 13 through the flow meter 39 to the core box 23. When the total mass of gas which has so flowed becomes equal to 2.5 lbs., the valving device 21 is closed, thereby terminating the cycle.

In another example involving a process developed by Ashland Chemical, Inc. in about 1968, the binder is cured using triethylamine (TEA) gas as a catalyst, typically in a 60% air–40% gas mixture. For this example, it is assumed that the core box 23 contains one hundred 20 lb. raw cores 47 to be cured. The total weight of binder required is about 1.2% of sand weight or about 24 lb. of binder (2000 lb. $\times$ 0.012). The mass of TEA gas need to cure 24 lb. of binder is about 0.01% of binder weight or about 0.0024 lb. of TEA gas. In the process, losses amount to about 0.09% of binder weight or about 0.0216 lb. of "lost" TEA as excess mass. Therefore, the total mass of TEA required for the assumed conditions is about 0.0240 lb. The value of the total required mass of gas mixture of 60% air and 40% TEA may then be readily computed. This value is then programmed into the counter/controller section and the curing cycle is initiated and terminated as described above.

After the foregoing is appreciated, several advantages of the new apparatus 10 and method will be apparent. For example, progressive fouling of the vents 25 of a core box 23 is a common experience. Such fouling is evidenced by an increased pressure drop across the core box 23. For a given source pressure, gas flows less rapidly to the core box 23 as the vents become progressively fouled. If a timer is used in connection with the foregoing apparatus 10 and method and if the operator then notes that the introduction of the predetermined mass of gas into the core box 23 occurs over progressively longer periods of time, this will signal the operator that such fouling is occurring. With a computerized instrumentation system, the arrangement 11 could be caused to shut down if the curing time exceeds a predetermined threshold value.

Another advantage of the new apparatus 10 and method is that the amount of curing gas which is wasted is dramatically reduced. That is, the amount of gas which is permitted to flow to the core box 23 is just equal to the predetermined value. There is no need to overgas the cores 47 "for safety's sake" (a common practice with known curing processes) to assure a fully cured core 47.

Yet another advantage is that there is no need to flow excess curing gas to the core box 23 to make up for actual or anticipated variations in the performance of the source 13. Variations in the gassing generator 13 may include changes in generator pressure and changes in heater performance, either or both of which result in a varying density of the curing gas. Variations in rate of gas output of the source 13 are automatically recognized and addressed by the new apparatus 10 and method since they base core curing upon the actual mass of gas curing constituent permitted to flow to a core box 23. In processes using carbon dioxide for curing sodium silicate binders, overcuring and consequent reduction of core shelf life will be materially recued.

Still another advantage of the invention is that gas cylinders 29 can be changed before they become empty. This is possible since the instrument system 19 can be readily configured to total the mass of gas used in a sequence of curing cycles. When this total approaches the weight of gas in the initial full cylinder 29, a signal is generated to alert the operator to the need to change the cylinder 29. Variations in the gassing generator may include changes in generator pressure and changes in heater performance, either or both of which result in a varying density of the curing gas. This feature also permits foundry operators to accurately predict the rate of consumption of gas with the result that the inventory (and the attendant cost) of stored gas can be minimized.

Still another advantage of the invention is that it dramatically reduces the occurrence of undercured cores 47. Such cores 47 are scrap, of no value and have a very significant impact upon the profitability of a foundry.

Still another advantage of the invention is that it helps prevent overcuring and "operator gassing." That is, when cores 47 are extracted from the core box 23, they are no longer permeated with excess curing gas or at most, have very little such excess gas. In overcured cores 47, such excess curing gas is released in the immediate vicinity of the operator. The least serious consequence of such release is that it creates an unpleasant working condition.

While the principles of this invention have been described in connection with specific embodiments, it should be understood clearly that these descriptions are made only by way of example and are not intended to limit the scope of the invention.

What is claimed is:

1. An improved apparatus for gas curing foundry cores confined in a core box, the apparatus including:

an instrument system for attachment to a source of curing gas and including a flow meter and a signal generating section for providing a plurality of first signals representing the mass flow rate of gas flowing to the core box, such instrument system further including a counter/controller section coupled to the signal generating section for totalizing the first signals;

a valving device coupled to the counter/controller section and opened for initiating the flow of gas to the core box and closed for terminating such flow;

the valving device being opened upon receipt of a signal initiating the curing process and closed when the total of the first signals reaches a value representing a predetermined mass of gas.

2. The apparatus of claim 1 wherein the flow meter includes sensors and wherein the signal generating section includes a sensing section coupled to the sensors for providing sensed signals which repetitively define a parameter, the value of which varies as a function of the mass flow rate of the gas flowing through the meter.

3. The apparatus of claim 2 wherein the signal generating section further includes an electronic section coupled to the sensing section and receiving the sensed signals, processing such signals and responsively providing a plurality of first signals.

4. An improved apparatus for gas curing foundry cores confined in a core box, the apparatus including:

a source or pressurized gas including a curing constituent;

a conductor connected to the source for flowing the gas to a foundry core box;

an instrument system attached to the conductor for determining the mass of curing constituent flowing to the core box;

a valving device coupled to the instrument system and opened for initiating the flow of gas to the core box and closed for terminating such flow;

the valving device being opened upon receipt of a signal initiating the curing process and closed when the instrument system determines that the total mass of curing constituent flowing to the core box has reached a predetermined value.

5. The apparatus of claim 4 wherein the gas is a mixture of a carrier gas and the curing constituent.

6. The apparatus of claim 4 wherein the gas is substantially pure curing constituent.

7. An improved method for gas curing foundry cores confined in a core box, the method comprising the steps of:

initiating flow of a gas to a core box, such gas including a curing constituent;

repetitively determining the mass of the gas which has flowed to the core box; and terminating the flow of gas when the total mass of gas which has flowed to the core box reaches a predetermined value.

8. The method of claim 7 wherein the gas is a mixture of a carrier gas and the curing constituent.

9. The method of claim 7 wherein the gas is substantially pure curing constituent.

10. An improved method for gas curing foundry cores confined in a core box and including the steps of:

in either order, determining the stoichiometric mass of a curing constituent required to cure such core and determining the excess mass of a curing constituent required to be introduced to the core box on account of losses which will occur during the curing process; and further including the steps of:

totalling the stoichiometric mass and the excess mass to obtain a predetermined value;

initiating flow of a gas to a core box, such gas including a curing constituent;

repetitively determining the mass of the curing constituent which has flowed to the core box; and terminating the flow of gas when the total mass of curing constituent which has flowed to the core box reaches such predetermined value.

11. The method of claim 10 wherein the cores are formed using a binder and wherein the stoichiometric mass is determined in view of the mass of the binder used to form such cores.

12. The method of claim 10 wherein the gas is a mixture of a carrier gas and the curing constituent.

13. The method of claim 10 wherein the gas is substantially pure curing constituent.

* * * * *